United States Patent [19]

Gaghan et al.

[11] 4,158,253

[45] Jun. 19, 1979

[54] SIMPLIFIED YARN COILER

[75] Inventors: Stephen B. Gaghan, Franklin Lakes, N.J.; Josiah W. Stahl, Jr., Taylors, S.C.

[73] Assignee: Greenville Steel Textile Machinery Corp., Greenville, S.C.

[21] Appl. No.: 868,918

[22] Filed: Jan. 12, 1978

[51] Int. Cl.[2] ..... B65H 54/00

[52] U.S. Cl. ..... 28/289; 19/159 R; 242/47

[58] Field of Search ..... 242/1, 47, 82, 83; 28/289; 19/159 R; 68/177

[56] References Cited

U.S. PATENT DOCUMENTS

| | | | |
|---|---|---|---|
| 349,148 | 9/1886 | Eccles | 242/82 |
| 1,121,480 | 12/1914 | Connelly | 242/82 |
| 2,936,509 | 5/1960 | Martin | 19/159 R |

*Primary Examiner*—George F. Mautz

*Attorney, Agent, or Firm*—Cushman, Darby & Cushman

[57] ABSTRACT

A simplified mechanism is provided for imparting motion to a frame member connected to the lower ends of a number of yarn conducting tubes so that the lower end of each tube moves in a circular path to dispense yarn in the form of a coil. A single horizontal motor driven shaft drives a worm gear which, through a gear reduction, drives crank arms connected to the frame member. A supporting box is provided mounted independently of the horizontal shaft for mounting the worm gear and gear reducers, allowing free access to those structures. The sole accessory components connected to the frame member are the yarn tubes and the crank arms.

14 Claims, 3 Drawing Figures

SIMPLIFIED YARN COILER

BACKGROUND AND SUMMARY OF THE INVENTION

There are numerous existing commercial structures for moving each of a plurality of yarn conducting tubes in a circular path to dispense material in the form of a coil from the lower ends of the tubes. While such structures are useful for performing their intended function, in the past, they have been extremely complicated making them difficult to manufacture and/or repair, having a plurality of horizontal shafts, gearing mechanisms, etc., and not being readily susceptible to modular construction. Additionally, prior art mechanisms have conventionally had the frame portions thereof tied together so that a common power unit can move two or more pluralities of yarn dispensing tubes simultaneously. Due to looseness in the connections between prior art frame members, one unit often runs ahead of the other, resulting in jamming and destruction of gearing and even fracturing of the gear mounting assemblies.

It is believed that the coiler according to the present invention is a distinct improvement over the prior art structures that avoids the problems inherent in the prior art structures due to their complicated nature and the tying together of frame members. According to the present invention, a coiling machine is provided that is simple—being both easy to construct and repair—may be constructed in modular form, and provides no interconnections between corresponding frame members, but rather can tie more than one plurality of tubes together to operate simultaneously without experiencing the destructive jamming that can and does occur in prior art coilers.

According to the present invention, a coiling machine for textile materials is provided comprising a plurality of depending tubes, each having an upper and lower end, and means for mounting the upper end of each of the tubes for swiveling movement such that the lower end of each tube may move in a circular path to dispense textile material from the lower end in the form of a coil. A first vertical drive shaft is provided and a substantially horizontally disposed frame member, having connections to accessory components consisting of connections to each of the plurality of tubes adjacent the lower end thereof, and to the first shaft. The connection from the frame member to the first shaft comprises means for interconnecting the first shaft to the frame member for converting rotational movement of the first shaft about a vertical axis into movement of the frame member so that the lower ends of the tubes are simultaneously moved in a circular path to dispense textile material from each lower end in the form of a coil. Drive train means are also provided for imparting rotary driving motion to the first shaft, the drive train means including a single motor driven horizontal shaft disposed vertically above the frame member and out of interfering engagement with the tubes; means for transforming rotation of the horizontal shaft about a horizontal axis into rotation of a second vertical shaft about a vertical axis, and gear reduction means interconnecting the first and second vertical shafts for rotating the first shaft at a lower angular velocity than the second shaft. When an interconnection between the plurality of tubes and a second plurality of tubes is provided, no connections between the frame members are provided, but rather a common drive is provided between the vertical drive shaft associated with each plurality of tubes.

Also according to the present invention, a supporting box is provided for supporting all of the components of the drive train means except for the horizontal shaft, the provision of the supporting box allowing a modular constructions of the coiler, and providing ready access to all of the working parts at a common location for ease of inspection and repair. The means for transforming rotation of the horizontal shaft into rotation of the second vertical shaft includes a horizontal shaft segment spaced from and parallel to the horizontal shaft, chain and sprocket drive means interconnecting the horizontal shaft and shaft segment, a worm gear formed on the horizontal shaft segment, and a first horizontal gear member formed on the second vertical shaft intermeshing with the worm gear, the supporting box supporting the first and second vertical shafts, the horizontal shaft segment, and the reduction gear means, as well as a sprocket of the chain and sprocket drive means. Supporting means extending downwardly from a plant ceiling or the like supports the supporting box independently of the horizontal shaft. The supporting box has two readily removable plates covering the open side faces so that ready access to the internal component parts of the box is provided, and ready access to all of the drive trains means components.

The frame member and the means for interconnecting the first vertical shaft and the frame member may comprise conventional structures. For instance, the frame member may comprise a ring interconnected around the periphery thereof to the plurality of tubes, and connected at the center thereof to a shaft for the crank arm mechanism; and the crank arm mechanism can comprise a plurality of crank arms with interconnecting gear members.

It is the primary object of the present invention to provide a simplified coiling machine for textile material. This and other objects of the invention will become clear from an inspection of the detailed description of the invention, and from the appended claims.

DETAILED DESCRIPTION OF THE DRAWINGS

Figure 1:
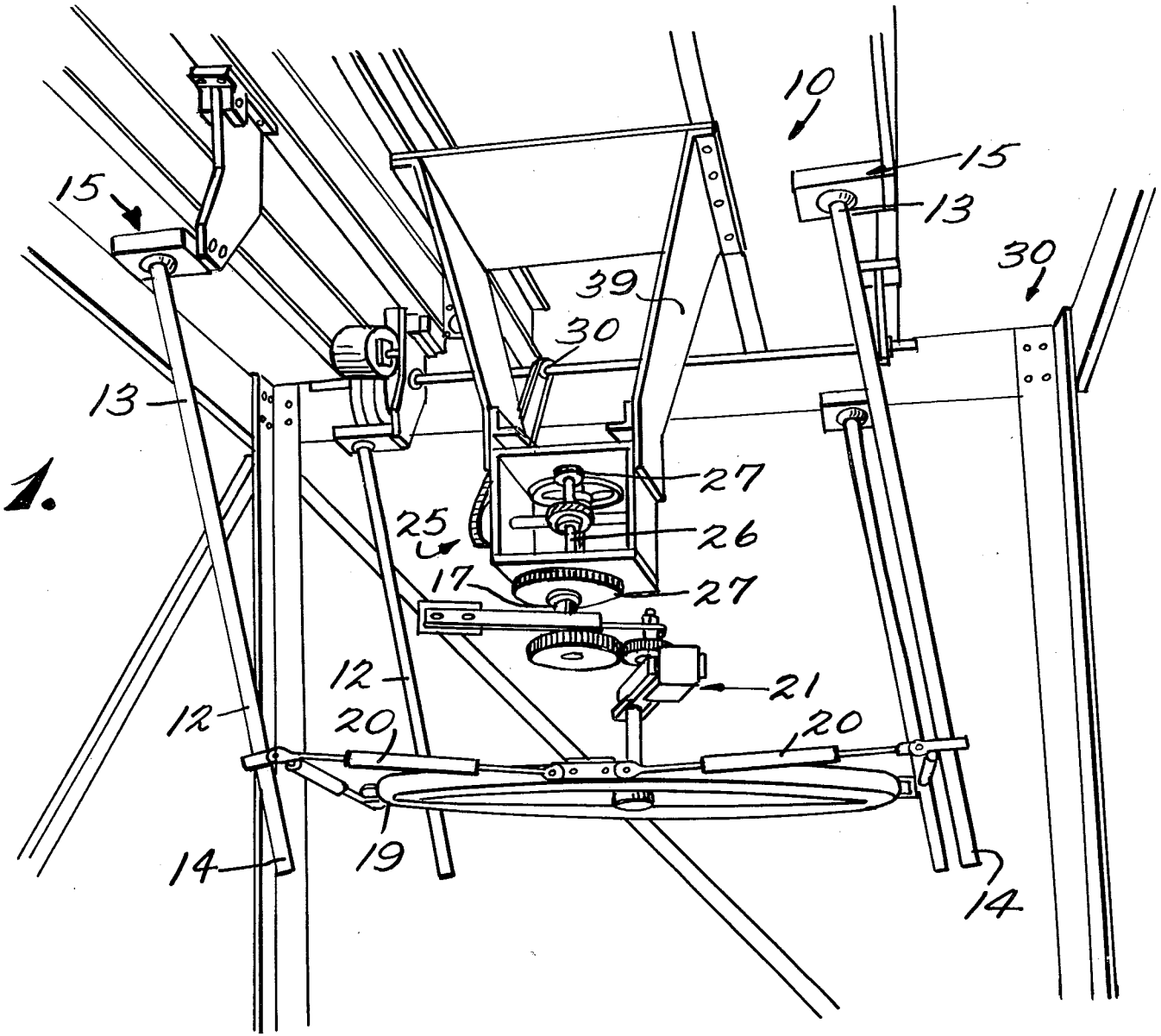
FIG. 1 is a perspective view of an exemplary machine according to the present invention, with four depending textile material dispensing tubes associated therewith.
Figure 2:
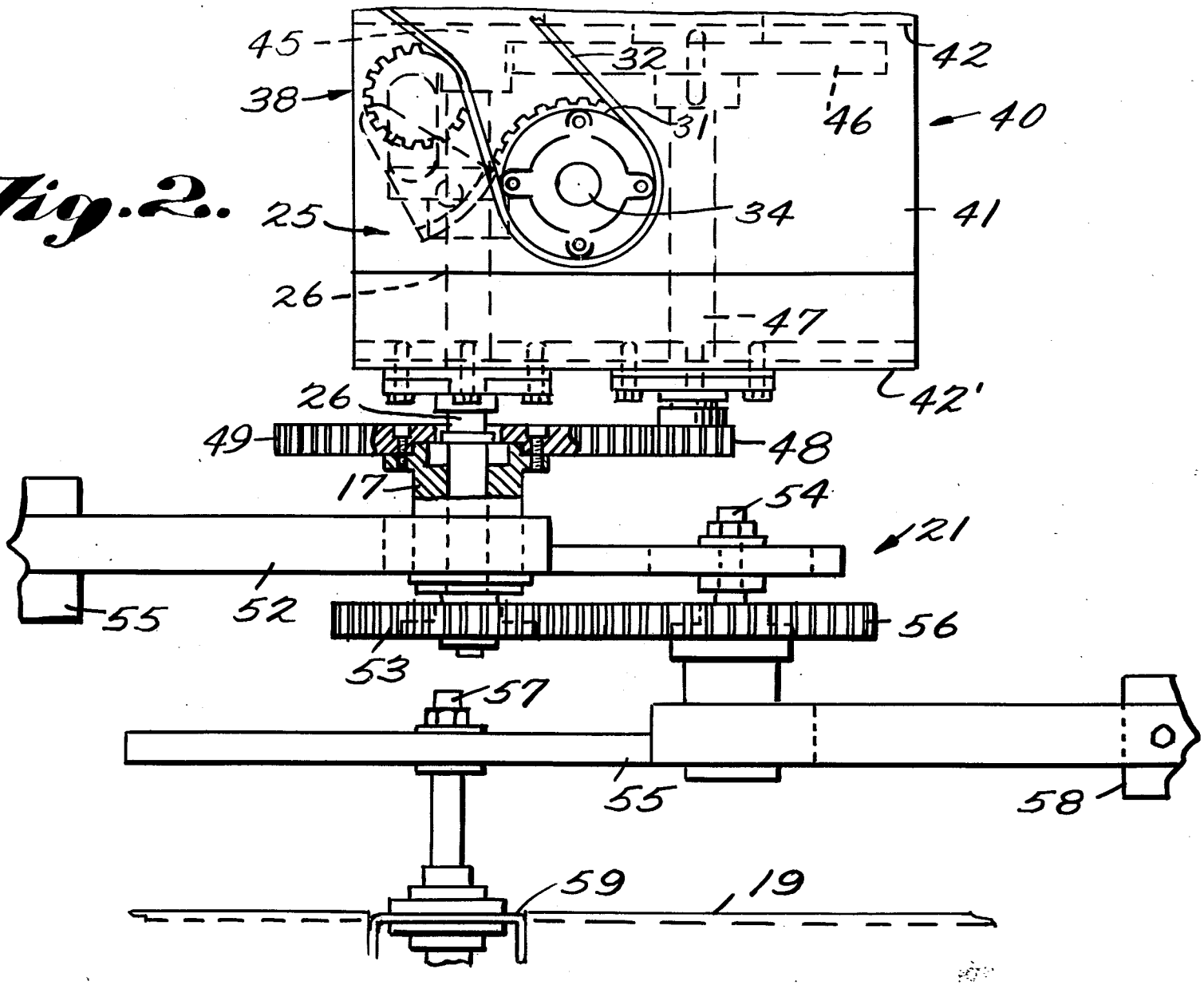
FIG. 2 is a detailed side view of the supporting box and crank arm mechanism of the machine of FIG. 1.

An exemplary coiling machine according to the present invention is shown generally at 10 in FIG. 1. The machine comprises a plurality of depending tubes 12 each having an upper end 13 and lower end 14 thereof, and means 15 (such as a universal joint) for mounting the upper end 13 of each tube 12 for swiveling movement such that the lower end 14 of each tube 12 may move in a circular path to dispense textile material from the lower end 13 in the form of a coil. The textile material is fed from a supply through the upper end 13 of a tube 12 then through the bottom of lower end 14 thereof. The machine also includes a first vertical, drive, shaft 17 (see FIG. 2 in particular), and a substantially horizontally disposed frame member 19—the frame member 19 having connections to accessory components consisting of (limited to) operative connections to each of the plurality of tubes 12 adjacent the lower ends 14 thereof, and to the first shaft 17. A plurality of adjustable length rods 20 comprise the connections from the periphery of the frame member 19 (which may be a ring as shown in FIG. 1), while the connection 21 from the frame member 19 to the first shaft 17 comprises means for interconnecting the first vertical drive shaft 17 to the frame member 19 for converting rotational movement of the shaft 17 about a vertical axis into movement of the frame member 19 so that the lower ends 14 of the tubes 12 are simultaneously moved in a circular path to dispense textile material from each lower end in the form of a coil. The interconnecting means 21 are shown in FIGS. 1 and 2. The machine 10 also comprises drive train means, shown generally at 23 in FIG. 1, for imparting rotary driving motion to the shaft 17, the drive train means 23 including a single, motor driven, horizontal shaft 24 disposed vertically above the frame member 19 and out of interfering engagement with the tubes 12, means 25 for transforming rotation of the shaft 24 about a horizontal axis into rotation of a second vertical shaft 26 about a vertical axis, and gear reduction means 27 for interconnecting the first and second shafts 17, 26, for rotating the first shaft 17 at a lower angular velocity than the second shaft 26.

Figure 3:
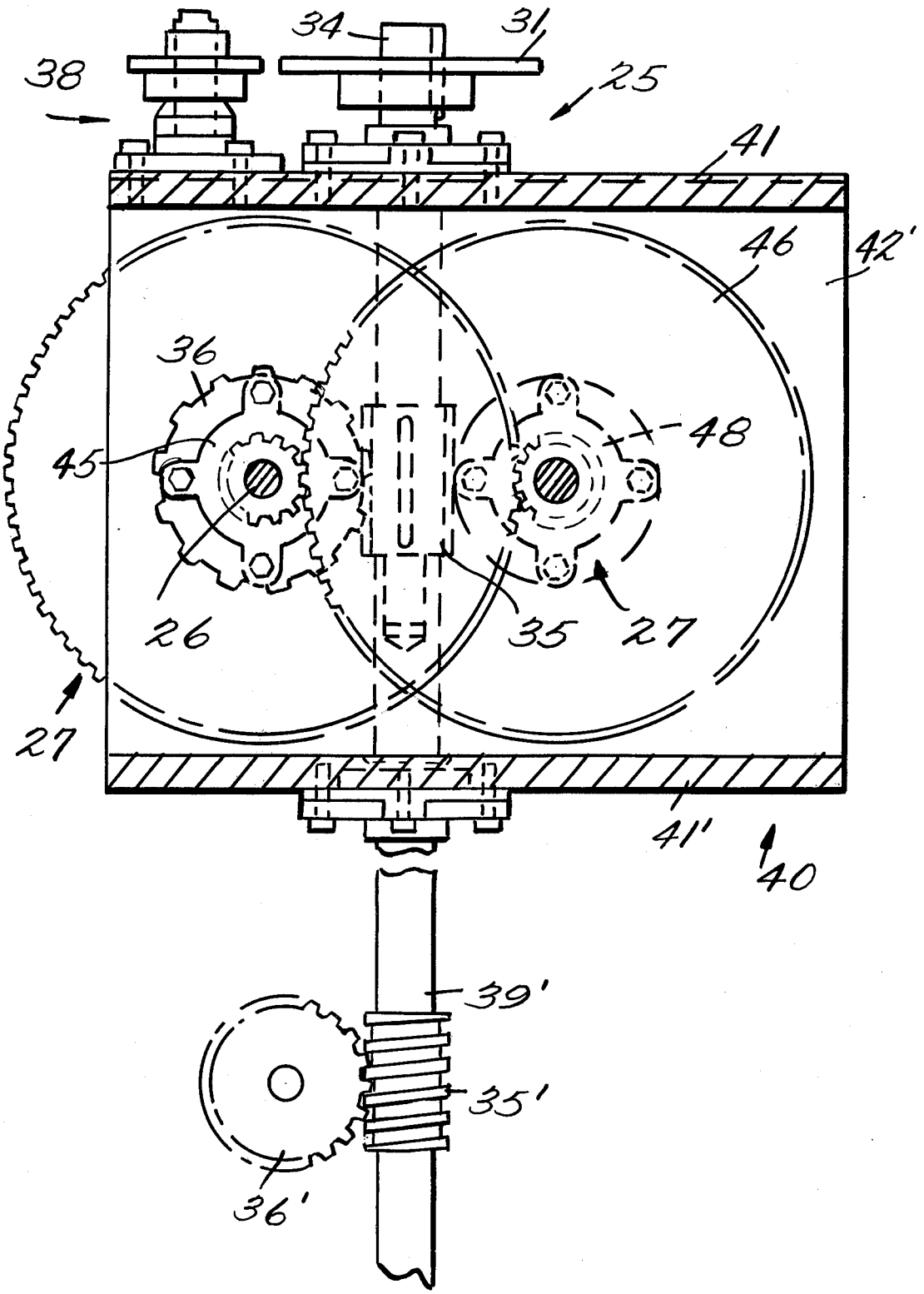
FIG. 3 is a plan view, with top removed, of the supporting box of FIGS. 1 and 2 and the gear mechanisms associated therewith.

The means 25 includes a pair of sprockets 30 (on shaft 24) and 31 interconnected by a chain 32, a horizontal shaft segment 34 spaced from and parallel to the shaft 24 and a worm gear 35 formed on the shaft segment 34, and a first horizontal gear member 36 formed on the second vertical shaft 26 and intermeshing with the worm gear 35. Tension of the chain 32—in order to provide a positive drive between the sprockets 30, 31—is provided by conventional tension means such as a Brewer "universal" drive tensioner, Model No. 2-S with idler shaft and sprockets (see 38 in FIG. 3).

A supporting box 40—which is suspended from the ceiling by supporting means 39 or the like—is provided for mounting all of the components of the drive train means except for the horizontal shaft 24 (and associated sprocket 30). The supporting box 40 allows for simple modular construction of the machine 10, and provides a common point for inspection and repair of the working parts of the driving mechanisms. The box 40 includes a pair of vertical side walls 41, 41' (see FIG. 3) and a pair of horizontal side walls 42, 42' (see FIG. 2). The other vertical sides of the box 40 are open to allow access to the worm gear 35, gear reduction means, 27 and the like; the open sides are preferably covered with readily removable sheet metal covers (not shown). The side walls 41, 41' provide the bushings for mounting the shaft segment 34 (with sprocket 31 exterior of box 40), and provide a mount for the chain tension maintainer 38. The top and bottom walls 42, 42' provide for mounting of the second vertical shaft 26 and all of the components of the gear reduction means 27 (to be hereafter described). Note that the first and second vertical shafts 17, 26 are shown to be coaxial in the drawings (see FIG. 2.

The gear reduction means 27 which are mounted by the supporting box 40 include a second horizontal gear member 45 mounted on the second vertical shaft 26; a third horizontal gear member 46, substantially larger than the gear 45, mounted on a third vertical shaft 47 and intermeshing with the gear 45; a fourth horizontal gear member 48 substantially smaller than the gear 46 and mounted on the shaft 47; and a fifth horizontal gear member 49 substantially larger than the fourth gear 48 and mounted on the first shaft 17 and intermeshing with the gear 48 (see FIG. 2.) The gears 45, 46 are disposed within the supporting box 40, and the gears 48, 49 are disposed exterior thereof.

The means 21 for interconnecting the shaft 17 and the frame member 19 may be any suitable arrangement for converting the rotational movement of the shaft 17 into movement of the frame member 19 so that the lower ends 14 of the tubes are simultanteously moved in a circular path to dispense textile material in the form of a coil. Exemplary such means 21 are shown in FIG. 1—and in detail in FIG. 2. Such means may comprise a crank arm 52 mounted on the first shaft 17 and having a gear member 53 associated therewith, a fourth vertical shaft 54 being associated with the arm 52 and horizontally offset from the shaft 17; a second crank arm 55 mounted on the fourth shaft 54 and having a second gear crank member 56 associated therewith, the gear crank member 53, 56 intermeshing; and a fifth vertical shaft 57 horizontally offset from the fourth shaft 54 and connected directly to the frame member 19 (at the center thereof) by a yoke 59 or the like.

As previously mentioned, no connections between the frame member 19 and any other frame members are provided. When it is desirable to use one motor to drive two or more sets of pluralities of tubes 12, the machine 10 according to the present invention provides for each of such connection without the descructive effects associated with the interconnection of frame members. One manner of providing for simultaneous drive of two or more pluralities of tubes 12 is to extend the shaft 24 (see extended portion 24' in FIG. 1) and to provide another sprocket 30' thereon, the other sprocket 30' cooperating with another sprocket like 31 mounted on another supporting box like box 40 (not shown). Alternatively, shaft 34 may be extended, as shown at 34' in FIG. 3, and another worm gear 35' and first horizontal gear 36' of another supporting box arrangement such as 40 (not shown) associated therewith. Such arrangements allow the simultaneous operation of two or more pluralities of tubes 12 while avoiding the jamming and destruction of gearing and associated problems inherent in the prior art when two or more frame members 19 themselves are tied together.

The apparatus according to the present invention having been described, an exemplary mode of operation thereof will now be set forth:

Supplies of yarn or like textile material feed the textile material up through the tops of the tubes 12, down through the tubes, to the bottoms 14 thereof. The motor driven shaft 24 is rotated, which rotates in turn shaft segment 34 through the chain and sprocket drive means 30, 31, 32, tension being supplied by the tensioner 38. Rotation of shaft segment 34 results in rotation of shaft 26 due to the interconnection between the gears 36, 35. The angular velocity of the first shaft 17 is reduced with respect to the shaft 26 through the reduction gear members 27 including gears 45, 46, 48 and 49, gear 49 being rigidly connected to first shaft 17. Rotation of shaft 17 then results in movement of the frame member 19 so that the lower ends 14 of all of the tubes 12 interconnected (by rods 20) to the frame member 19 are simultaneously moved in a circular path to dispense the textile material from each lower end 14 in the form of a coil (into a cannister, around a spool, or the like). Drive of a second frame member 19 can be provided simultaneously by provision of another sprocket 30' on an extended horizontal shaft 24' or by providing an extended horizontal shaft 24' or by providing an extended shaft segment 34.

It will thus be seen that according to the present invention a simplified coiler has been provided that has a minimum number of parts, allows modular construction, provides a single location for inspection and/or repair of the drive train components, and is not susceptible to the destructive jamming inherent in prior art mechanisms with interconnected frame members. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A coiling machine for textile material comprising a plurality of depending tubes, each having an upper and lower end;

means for mounting the upper end of each of said tubes for swiveling movement such that the lower end of each tube may move in a circular path to dispense textile material from said lower end in the form of a coil;

a first vertical, drive, shaft;

a substantially horizontally disposed frame member having connections to accessory components consisting of operative connections to each of said plurality of tubes adjacent the lower ends thereof, and to said first shaft;

said connection from said frame to first shaft comprising means interconnecting said first vertical, drive, shaft to said frame member for converting rotational movement of said first shaft about a vertical axis into movement of said frame member so that the lower ends of said tubes are simultaneously moved in a circular path to dispense textile material from each lower end in the form of a coil; and drive train means for imparting rotary driving motion to said first vertical drive shaft, said drive train means including shaft means consisting of a single, motor-driven, horizontal shaft disposed vertically above said frame member and out of interfering engagement with said tubes; means for transforming rotation of said horizontal shaft about a horizontal axis into rotation of a second vertical shaft about a vertical axis; and gear reduction means interconnecting said first and second vertical shafts for rotating said first shaft at a lower angular velocity than said second shaft.

2. A coiling machine as recited in claim 1 wherein said means for transforming rotation of said horizontal shaft into rotation of said second vertical shaft includes a horizontal shaft segment spaced from and parallel to said horizontal shaft, chain and sprocket drive means interconnecting said horizontal shaft and shaft segment, a worm gear formed on said horizontal shaft segment, and a first horizontal gear member formed on said second vertical shaft intermeshing with said worm gear.

3. A coiling machine as recited in claim 2 further comprising a supporting box for supporting said first and second vertical shafts and said horizontal shaft segment and said reduction gear means, and a sprocket of said chain and sprocket drive means; and supporting means for supporting said supporting box independently of said horizontal shaft.

4. A coiling machine as recited in claim 3 wherein said supporting box has two open generally vertically disposed side faces which allow ready access to said worm and first horizontal gear member, and wherein the sprocket of said chain and sprocket means is mounted on the exterior of one of the vertical walls of said supporting box.

5. A coiling machine as recited in claim 4 further compising a tensioning means for said chain of said chain and sprocket drive means, said tensioning means mounted on the same face of said supporting box as said sprocket mounted on said supporting box.

6. A coiling machine as recited in claim 2 wherein said gear reduction means comprises a second horizontal gear member mounted on said second vertical shaft; a third horizontal gear member, substantially larger than said second member, mounted on a third vertical shaft, and intermeshing with said second member; a fourth horizontal gear member, substantially smaller than said third gear member, mounted on said third vertical shaft; and a fifth horizontal gear member, substantially larger than said fourth gear member, mounted on said first vertical shaft and intermeshing with said fourth member.

7. A coiling machine as recited in claim 6 wherein said first and second vertical shafts are coaxial.

8. A coiling machine as recited in claim 1 wherein said means for interconnecting said first vertical shaft and said frame member comprises a first crank arm mounted on said first shaft and having a first crank gear member associated therewith, a fourth vertical shaft being associated with said first crank arm horizontally offset from said first vertical shaft, a second crank arm mounted on said fourth vertical shaft and having a second crank gear member associated therewith and mounted on said fourth vertical shaft and intermeshing with said first crank gear member; and a fifth vertical shaft horizontally offset from said fourth vertical shaft and connected directly to said frame member.

9. A coiling machine as recited in claim 8 wherein said frame member comprises a ring, and wherein said fifth vertical shaft is connected to the center of said ring and said lower ends of said tubes are connected to the periphery of said ring.

10. A coiling machine as recited in claim 1 further comprising a second plurality of depending tubes and associated frame member, and means unconnected to said frame member or said second frame member for providing a common drive for simultaneous movement of said plurality of tubes and said second plurality of tubes.

11. In a coiling machine for textile material comprising a plurality of depending tubes, each having an upper and lower end; means for mounting the upper end each of the tubes for swiveling movement so that the lower end of each tube may move in a circular path to dispense textile material from said lower end in the form of a coil; a first vertical drive shaft; a substantially horizontally disposed frame member having connections to accessory components including operative connections to each of said plurality of tubes adjacent to lower ends thereof, and said first shaft; said connection from said frame to said first shaft comprising means interconnecting said first vertical, drive, shaft to said frame member for converting rotational movement of said first shaft about a vertical axis into movement of said frame member so that the lower ends of said tubes are simultaneously moved in a circular path to dispense textile material from each lower end in the form of a coil; drive train means for imparting rotary driving motion to said first vertical drive shaft, said drive train means including: a horizontal shaft; means for transforming rotation of said horizontal shaft about a horizontal axis into rotation of a second vertical shaft about a vertical axis, and gear reduction means for rotating said first shaft at a lower angular velocity than said second shaft; wherein the improvement comprises:

said means for transforming rotation of said horizontal shaft into rotation of said second vertical shaft including a horizontal shaft segment spaced from and parallel to said horizontal shaft, drive means interconnecting said horizontal shaft and shaft segment, a worm gear formed on said horizontal shaft segment, and a first horizontal gear member formed on said second vertical shaft intermeshing with said worm gear, and wherein the improvement further comprises a supporting box for supporting said first and second vertical shafts and said horizontal shaft segment and said gear reduction means, and a component of said drive means; and supporting means for supporting said supporting box independently of said horizontal shaft.

12. In a coiling machine as recited in claim 11 wherein said supporting box has two open generally vertically dispose said faces which allow ready access to said worm and said first horizontal gear member, and wherein said component of said drive means is mounted on the exterior of one of the vertical walls of said supporting box.

13. In a coiling machine is recited in claim 12 wherein said drive means comprises a chain and sprocket drive means, and wherein said component mounted on the exterior of one of the vertical walls supporting box comprises a sprocket; the improvement further comprising a tensioning means for said chain of said chain and sprocket drive means, said tensioning means mounted on the same face of said supporting box as said sprocket mounted on said supporting box.

14. In a coiling machine for textile material comprising a plurality of depending tubes, each having an upper and lower end; means for mounting the upper end each of the tubes for swiveling movement so that the lower end of each tube may move in a circular path to dispense textile material from said lower end in the form of a coil; a first vertical drive shaft; a substantially horizontally disposed frame member having connections to accessory components including operative connections to each of said plurality of tubes adjacent to lower ends thereof, and said first shaft; said connection from said frame to said first shaft comprising means interconnecting said first vertical, drive, shaft to said frame member for converting rotational movement of said first shaft about a vertical axis into movement of said frame member so that the lower ends of said tubes are simultaneously moved in a circular path to dispense textile material from each lower end in the form of a coil; drive train means for imparting rotary driving motion to said first vertical drive shaft, said drive train means including: a horizontal shaft; means for transforming rotation of said horizontal shaft about a horizontal axis into rotation of a second vertical shaft about a vertical axis, and gear reduction means for rotating said first shaft at a lower angular velocity than said second shaft; wherein the improvement comprises:

said means for transforming rotation of said horizontal shaft into rotation of said second vertical shaft including a horizontal shaft segment spaced from and running parallel to said horizontal shaft, drive means interconnecting said horizontal shaft and said shaft segment, a worm gear formed on said horizontal shaft segment, and a first horizontal gear member formed on said second vertical shaft intermeshing with said worm gear, and wherein the improvement further comprises said gear reduction means comprising a second horizontal gear member mounted on said second vertical shaft; a third horizontal gear member, substantially larger than said second member, mounted on a third vertical shaft, and intermeshing with said second member; a fourth horizontal gear member, substantially smaller than said third gear member, mounted on said third vertical shaft; and a fifth horizontal gear member, substantially larger than said fourth gear member, mounted on said first vertical shaft and intermeshing with said fourth member; said first and second vertical shafts being coaxial.

* * * * *